US009545982B2

(12) United States Patent
Godoy

(10) Patent No.: US 9,545,982 B2
(45) Date of Patent: Jan. 17, 2017

(54) BREATHING DEVICE FOR DIVERS

(71) Applicant: Carlos Alberto Godoy, Genoa (IT)

(72) Inventor: Carlos Alberto Godoy, Genoa (IT)

(73) Assignee: Cressi-Sub S.p.A., Genoa (IT)

( * ) Notice: Subject to any disclaimer, the term of this patent is extended or adjusted under 35 U.S.C. 154(b) by 326 days.

(21) Appl. No.: 13/926,000

(22) Filed: Jun. 25, 2013

(65) Prior Publication Data

US 2014/0014096 A1 Jan. 16, 2014

(30) Foreign Application Priority Data

Jul. 13, 2012 (IT) ..... MI2012A1229

(51) Int. Cl.
*B63C 11/16* (2006.01)
*B63C 11/20* (2006.01)

(52) U.S. Cl.
CPC ..... *B63C 11/207* (2013.01); *B63C 11/205* (2013.01)

(58) Field of Classification Search
CPC ..... B63C 11/00; B63C 9/00; B63C 2011/005; B63C 11/207; B63C 11/205
USPC ..... 128/201.11, 200.29, 200.27, 201.27; 405/185–187
See application file for complete search history.

(56) References Cited

U.S. PATENT DOCUMENTS 2,815,751 A * 12/1957 Ferraro ..... B63C 11/16 128/201.11
5,404,872 A * 4/1995 Choi ..... B63C 11/205 128/201.11
5,960,791 A * 10/1999 Winefordner ..... B63C 11/205 128/201.11
6,276,362 B1 * 8/2001 Chen-Lieh ..... B63C 11/205 128/201.11
6,904,910 B2 * 6/2005 Christianson ..... B63C 11/205 128/201.11
6,994,085 B2 * 2/2006 Shiue ..... B63C 11/205 128/201.11
7,077,127 B2 * 7/2006 Christianson ..... B63C 11/205 128/201.11
7,165,545 B1 * 1/2007 Shiue ..... B63C 11/205 128/201.11
7,708,012 B2 * 5/2010 Shiue ..... B63C 11/205 128/201.11
2005/0274380 A1 * 12/2005 Shiue ..... B63C 11/205 128/201.11
2006/0254582 A1 * 11/2006 Christianson ..... A62B 9/02 128/201.11
2008/0047552 A1 * 2/2008 McCarthy ..... B63C 11/205 128/201.11
2008/0092883 A1 * 4/2008 Shiue ..... B63C 11/205 128/201.11

(Continued)

*Primary Examiner* — Bradley Philips
*Assistant Examiner* — Victoria Leszczak
(74) *Attorney, Agent, or Firm* — Blank Rome LLP

(57) ABSTRACT

A breathing device for divers that includes a breathing tube exhibiting an end having an inclined opening, an obturator that is mobile between an open position and a closed position of the opening of the end, a float that activates the obturator, a first articulator that communicates the obturator to the tube, a second articulator that communicates the float to the tube. The first and the second articulators can each exhibit a respective hinge axis to the tube. The hinge axis to the tube of the second articulator can be more greatly distanced from the end of the tube relative to the hinge axis to the tube of the first articulator.

13 Claims, 5 Drawing Sheets

(56) References Cited

U.S. PATENT DOCUMENTS

| | | | | |
|---|---|---|---|---|
| 2010/0132701 | A1* | 6/2010 | Fukasawa | B63C 11/205 128/201.11 |
| 2010/0229858 | A1* | 9/2010 | Wheelwright | B63C 11/205 128/201.11 |
| 2011/0180066 | A1* | 7/2011 | Lan | B63C 11/205 128/201.11 |

* cited by examiner

BREATHING DEVICE FOR DIVERS

RELATED APPLICATIONS

This application claims benefit of priority under 35 USC §119 of Italy Patent Application No. MI2012A 001229, filed Jul. 13, 2012, entitled "A Breathing Device for Divers," which application is incorporated herein by reference.

FIELD OF THE INVENTION

The present invention relates to a breathing device for divers; and more particularly to a snorkel, the use of which is destined for surface swimming and immersion to modest depths, in apnoea.

BACKGROUND OF THE INVENTION

In general, a device of this type comprises a tube provided at a first open end with a mouthpiece and at a second open end with automatic closing means for preventing inlet of water in the presence of waves or during immersion in apnoea.

In the majority of cases, the automatic closing means comprise a float which commands an obturator of the second end of the tube.

According to patent U.S. Pat. No. 2,815,751, the second end of the tube exhibits a semi-circular shape and its opening is therefore facing downwards. The tube is further provided with a pair of superposed brackets that are oscillatable about the same oscillating axis. The bracket that is closer to the second end of the tube includes the obturator, while the bracket that is further from the second end of the tube terminates with the float which pushes the obturator to close the opening of the second end of the tube, when the second end is immersed. When the tube is not in a horizontal position or when it is indeed turned over, during the diver's swim under the surface, the float loses the function of pushing the obturator to close against the opening of the second end of the breathing tube and in this case it is only the hydrostatic pressure that keeps the obturator in the closed position. Apart from the limited functioning of the float, when the tube is not in the vertical position with the second end of the tube facing upwards, the automatic closing means have an excessive volume and a heterogeneity of the component elements which are also made with different materials, and therefore the technical solution is rather expensive.

According to patent application WO 96 03313, the float and the obturator are hinged together directly on the opening of the breathing tube, such as to reduce the volume of the device. The constructional simplicity is not however accompanied by a reliable safety of functioning in view of the precarious nature of the hinge means.

In patent U.S. Pat. No. 5,960,791 the obturator and the float form a single piece which leads to a reduction in volume at the cost of functionality as since the obturator is solidly constrained to the float, when the float oscillates due to the presence of waves or the movement of the diver's head, water spray can undesiredly find its way internally of the tube.

SUMMARY OF THE INVENTION

Embodiments of the present invention will be seen variously to realize a breathing device for underwater divers:

which obviates the technical drawbacks found in the prior art; and where the automatic closing means of an end of the tube exhibits:

- a small volume;
- a great simplicity of construction;
- a high mechanical resistance;
- a low cost; and
- a reliable safety of functioning independently of the orientation of the tube.

The above is attained by realising a breathing device for divers having a breathing tube exhibiting an end having an inclined opening, an obturator that is mobile between an open position and a closed position of the opening of the end, a float that activates the obturator, a first articulator that communicates the obturator with the tube, and a second articulator that communicates the float with the tube. The first and the second articulators can exhibit a respective hinge axis to the tube, extending across the tube. The hinge axis to the tube of the second articulator can be more greatly distanced from the end of the tube relative to the hinge axis to the tube of the first articulator.

Other characteristics of the present invention are further defined in the following claims.

BRIEF DESCRIPTION OF THE DRAWINGS

Further characteristics and advantages of the invention will become more fully apparent from the description of a preferred but not exclusive embodiment of the breathing device for divers according to the invention, illustrated by way of non-limiting example in the accompanying drawings, in which.

DETAILED DESCRIPTION OF THE ILLUSTRATED EMBODIMENTS

Figure 1:
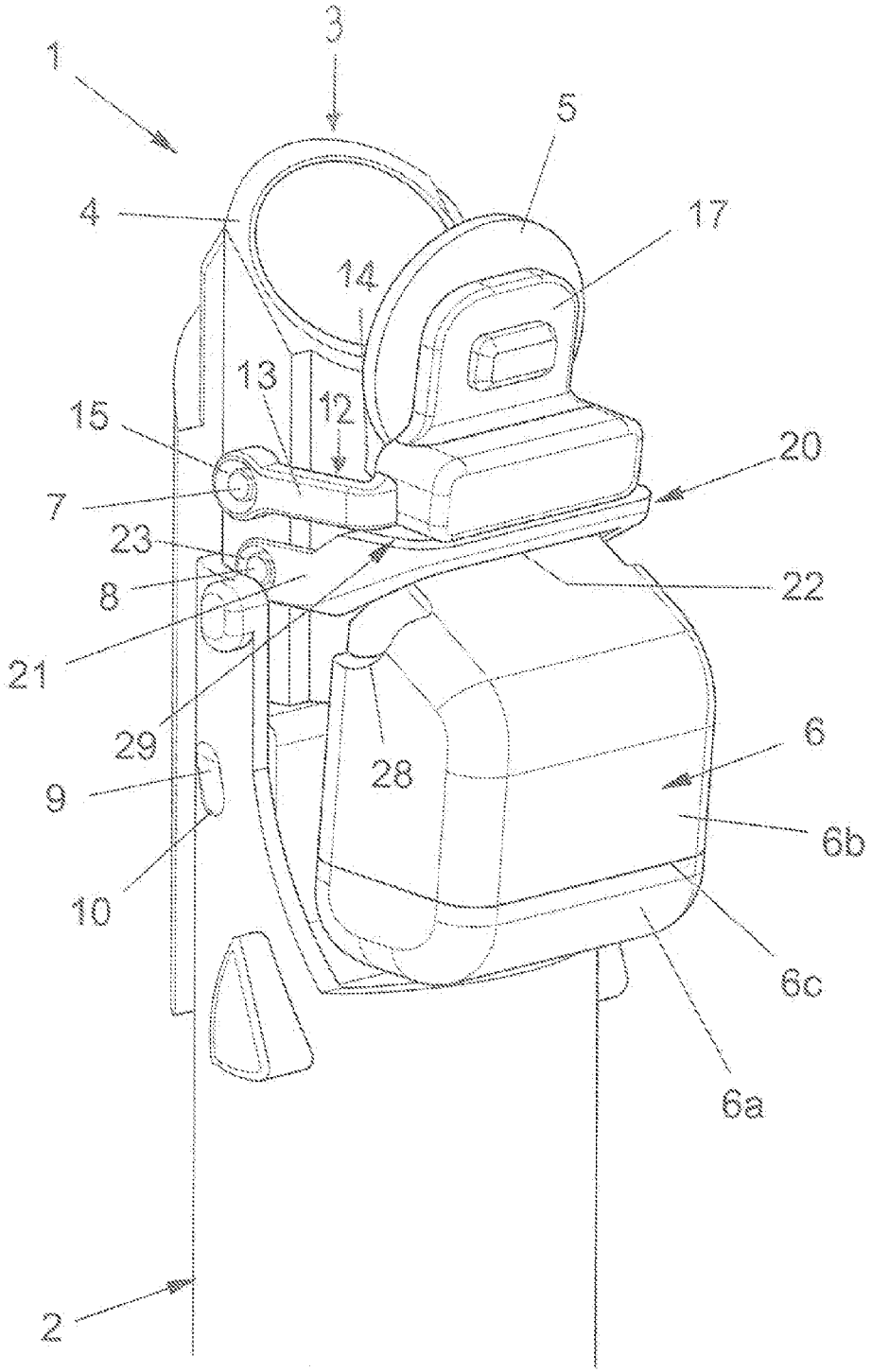
FIG. 1 is a perspective view of a breathing device with an obturator in an open position.
Figure 3:
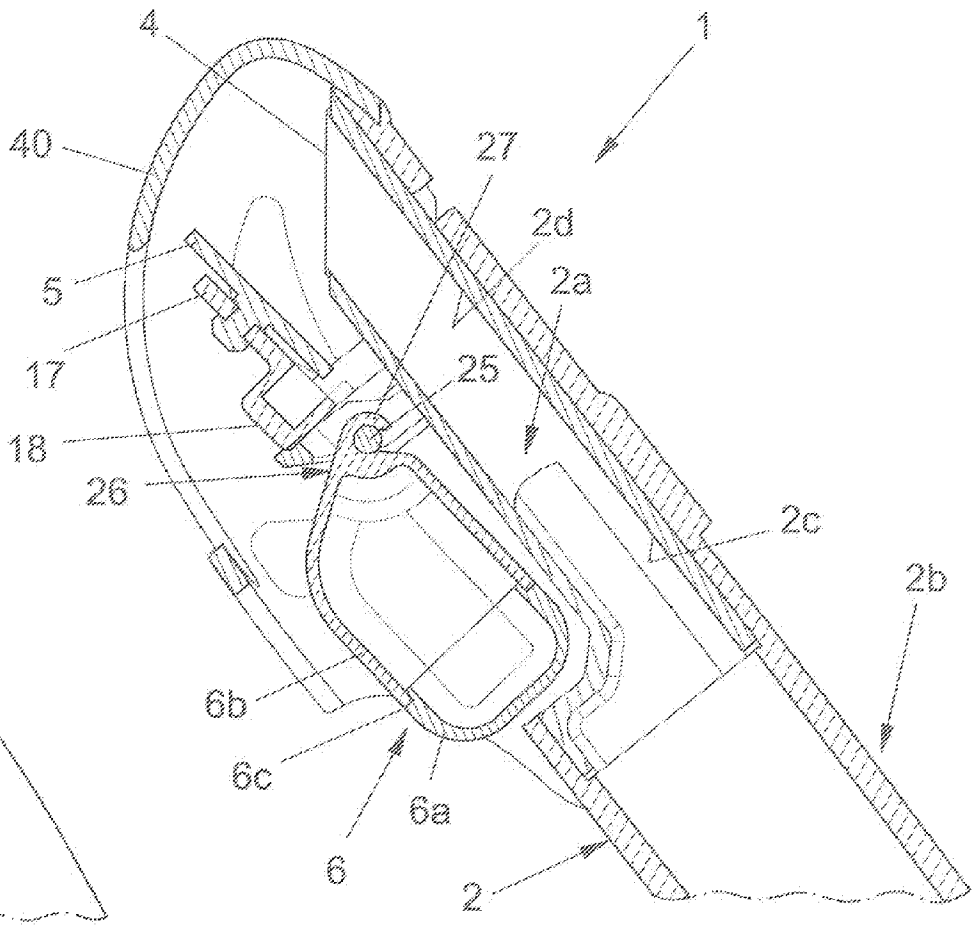
FIG. 3 shows the breathing device with the obturator in the open position in vertical section, also detailing a protection cap.
Figure 2:
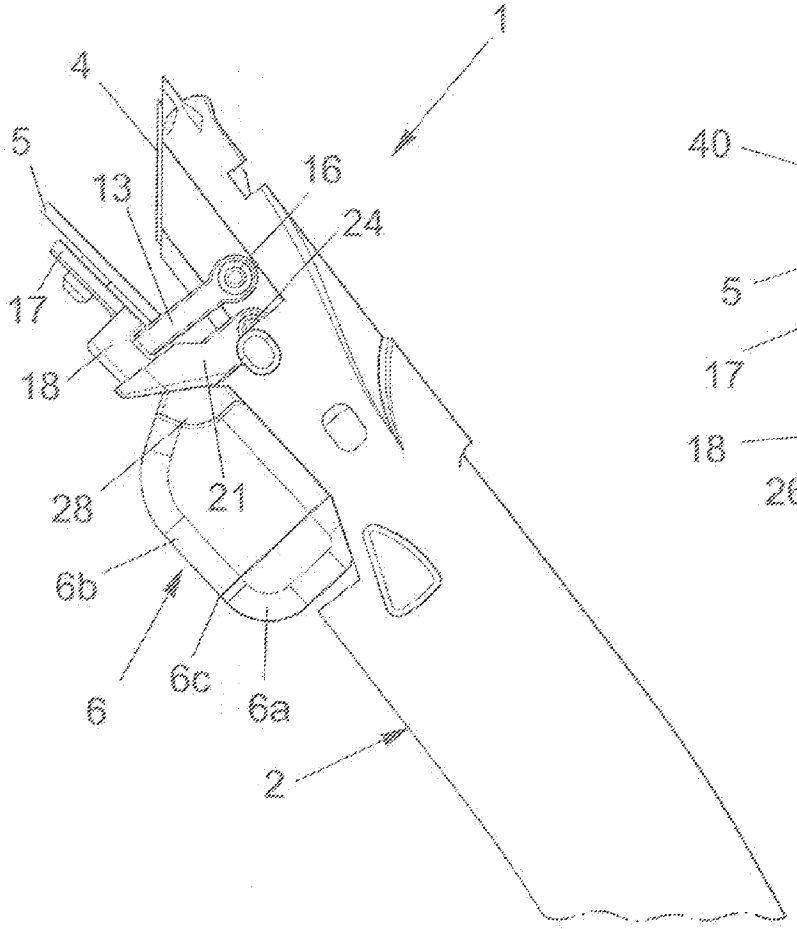
FIG. 2 shows the breathing device with the obturator in the open position in a lateral view.
Figure 4:
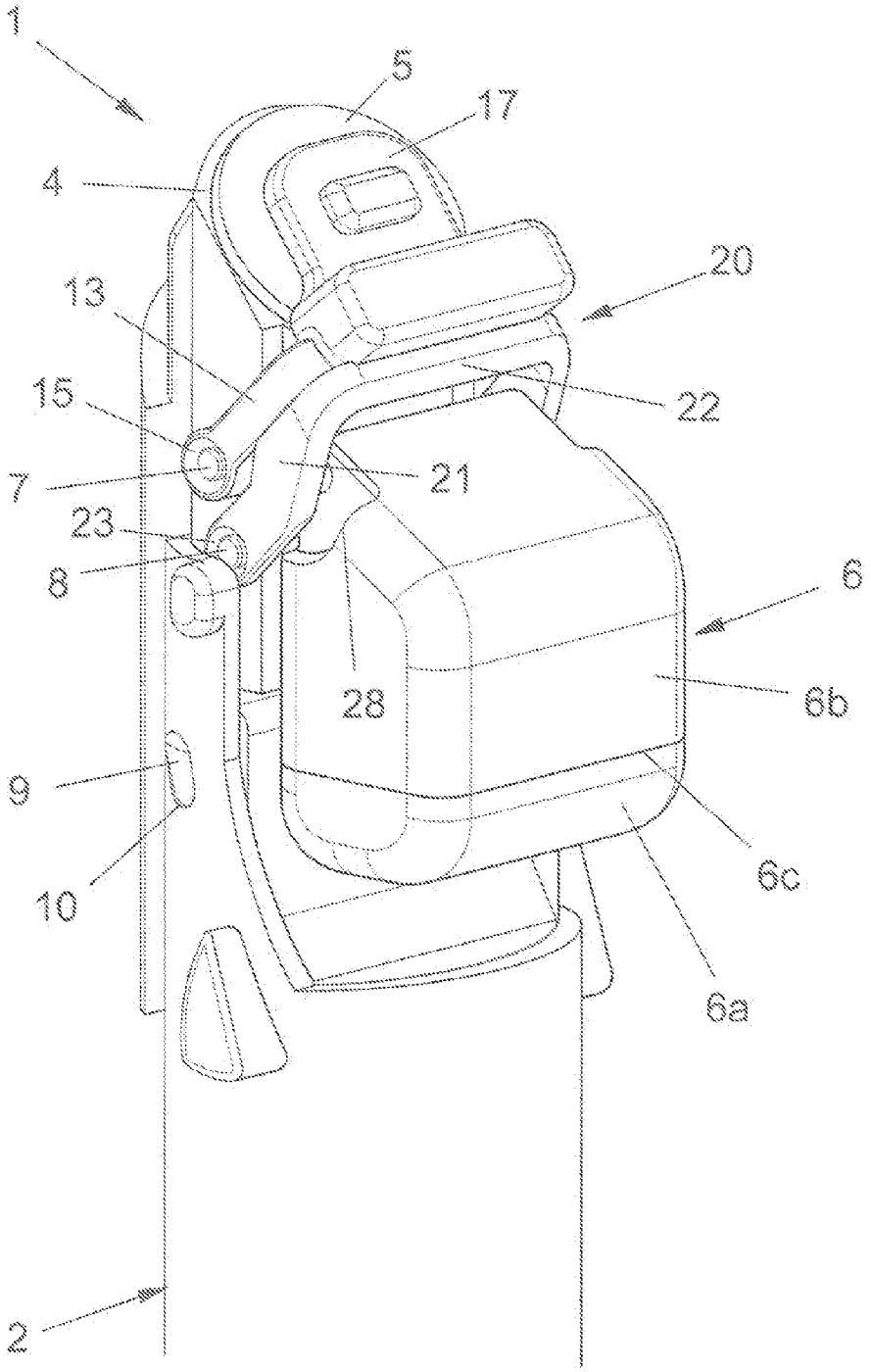
FIGS. 4, 5 and respectively FIG. 6 are similar to FIGS. 1, 2, and respectively FIG. 3, but relate to the breathing device with the obturator in a closed position.
Figure 6:
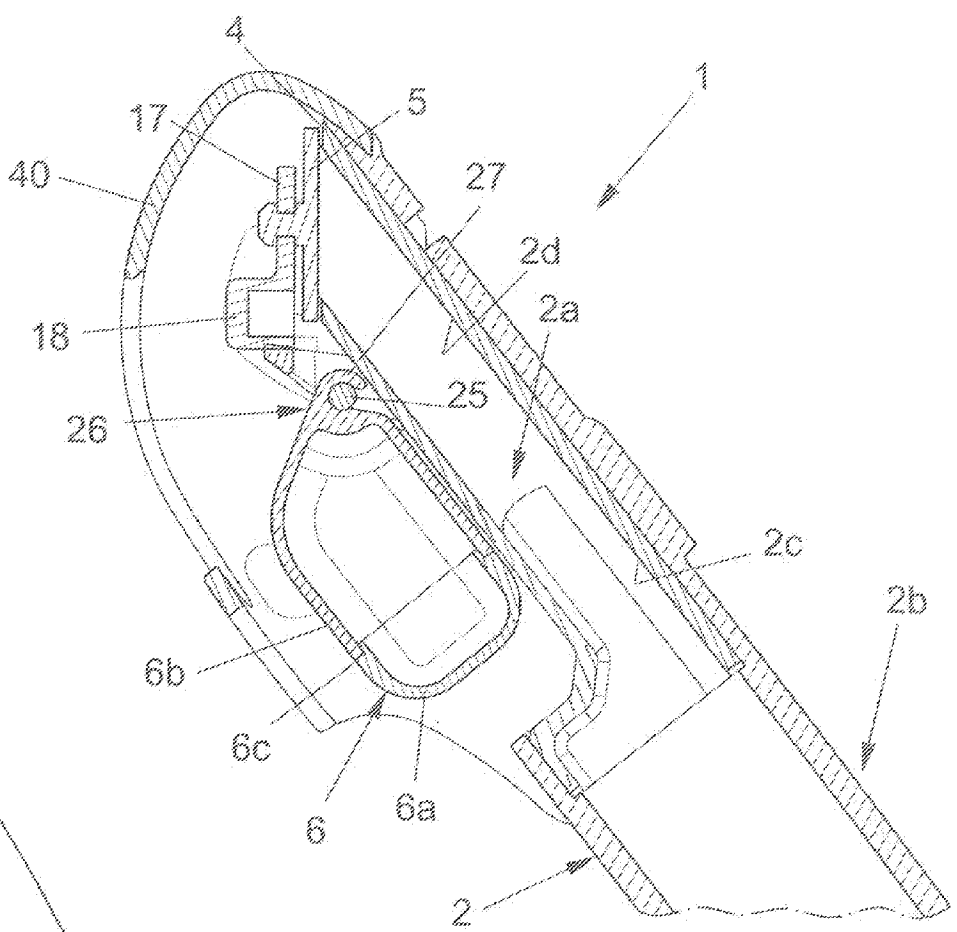
Figure 5:
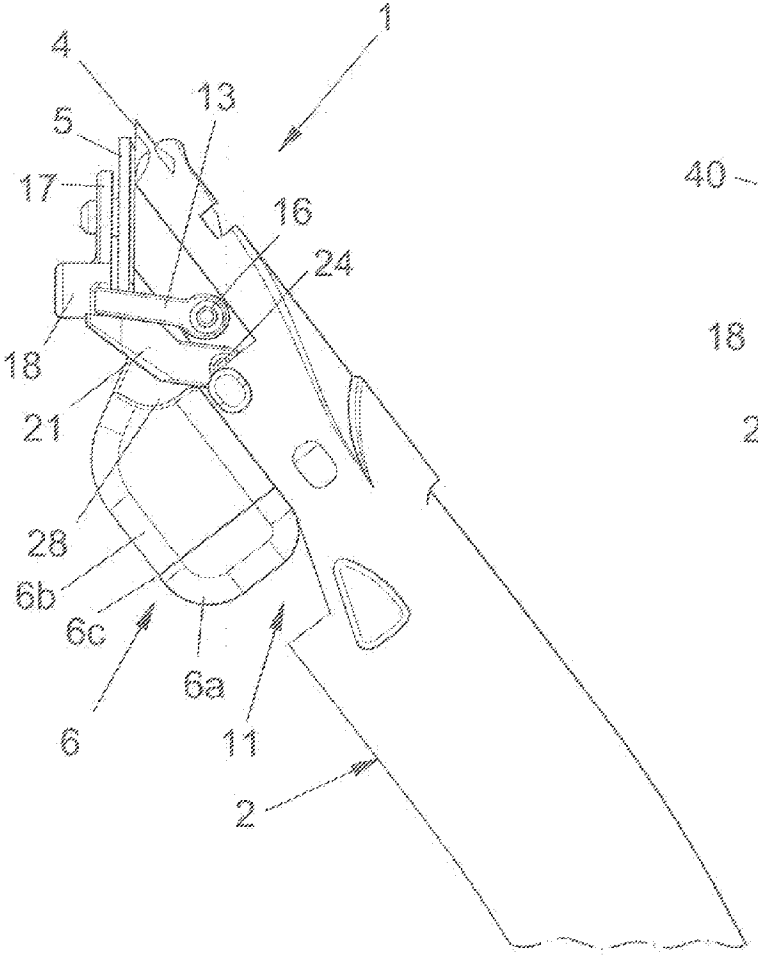
Figure 7:
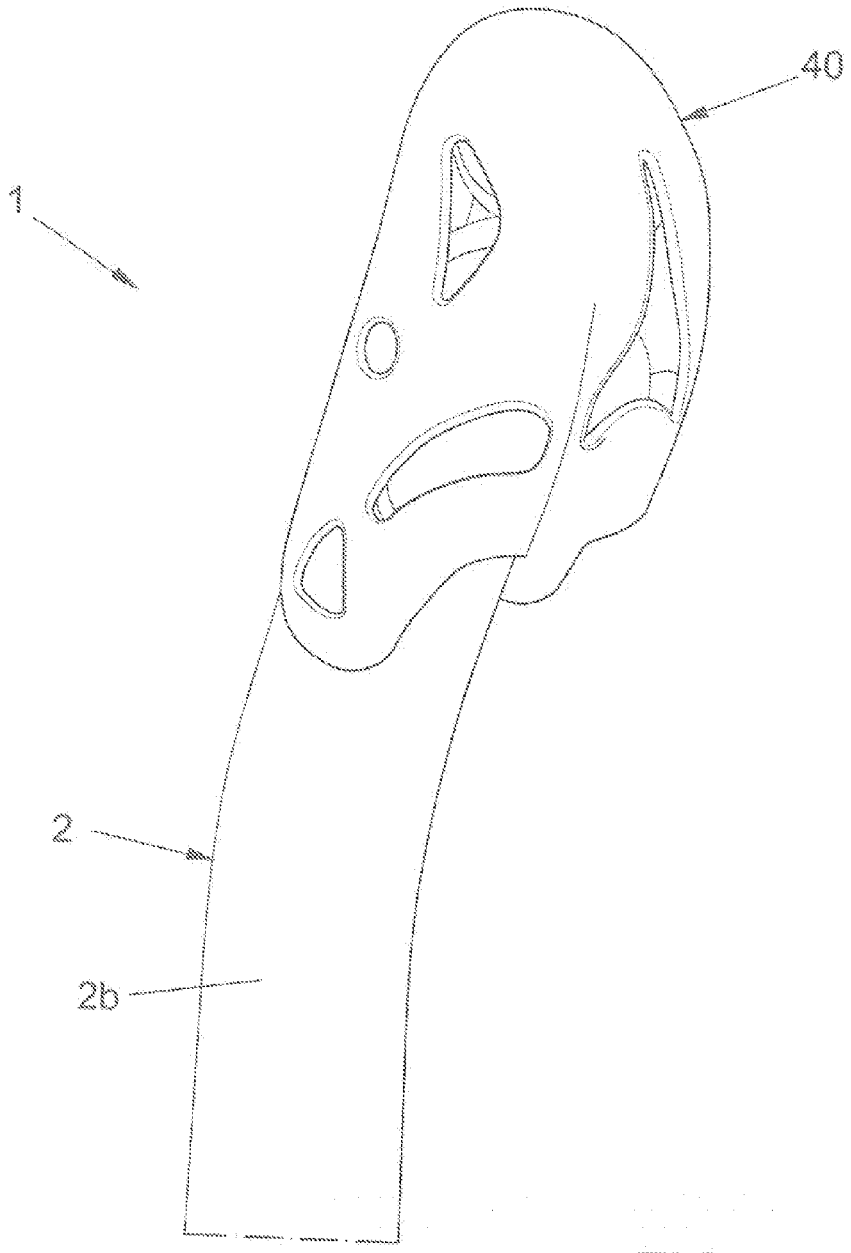
FIG. 7 illustrates a perspective view of the breathing device.

With reference to the figures, a breathing device for divers is illustrated, denoted in its entirety by reference numeral 1.

The breathing device 1 comprises a breathing tube 2 having an end 3 with an opening 4, an obturator 5 mobile between an open position and a closed position of the opening 4 of the end 3 of the breathing tube 2, a float 6 for activating the obturator 5, a first articulator (first articulation means) of the obturator 5 to the breathing tube 2, and a second articulator (second articulation means) of the float 6 to the breathing tube 2.

The opening 4 lies on an inclined plane with respect to the longitudinal axis of the breathing tube 2.

The obturator 5 has a flat shape the end of which has a profile alike to the profile of the opening 4 of the end 3 of the tube 2 which in turn functions as the valve seating, such that when the obturator 5 is rested above the opening 4, it closes the opening sealingly via the seal gasket, not illustrated in detail and made in a known way.

The first articulation means and the second articulation means exhibit a respective hinge axis 7, 8 to the breathing tube 2 extending across the tube 2. The hinge axis 8 to the tube 2 of the second articulation means is advantageously arranged parallel to and at a greater distance from the end 3 of the tube 2 with respect to the hinge axis 7 to the tube 2 of the first articulation means.

In particular, the hinge axes 7, 8 are orientated transversally to the longitudinal axis of the tube 2 and at a terminal longitudinal section that is straight and has a small transversal tract 2*a* of the tube 2 to which the end 3 belongs.

The tract 2*a* of the tube 2 preferably represents a distinct piece from the piece constituting the remaining part 2*b* of the tube. The piece which forms the tract 2*a* exhibits a connecting part 2*c* having an external transversal section complementary to the internal transversal section of the piece which forms the tract 2*b* in which it is jointed, and a part 2*d* having a smaller transversal section. The axial removal of the two pieces is prevented by special teeth 9 formed on a piece and engaged in respective snap seatings 10 provided on the other piece.

The reduction of the transversal section of the tract 2*a* of tube 2 defines a recess 11 of the tube for the at least partial containing of the volume of the float 6 in a transversal direction to the tube 2.

The tube 2 exhibits, at the tract 2*b* thereof, a longitudinal cladding (not shown) co-moulded in a rough material such as to retain in position the fastening ring of the tube 2 to the mask (not illustrated).

The first articulation means comprise a first bracket 12 exhibiting two parallel arms 13 that project from the tube 2 and extend perpendicularly to the hinge axis 7 and are reciprocally connected by a crosspiece 14.

The hinge axis 7 is defined by a pair of rotating pins 15 which extend from the tube 2 radially in an external direction and engage in a respective hole 16 afforded at an end of a respective arm 13 of the first bracket 12.

Naturally it is alternatively possible to include the holes 16 on the tube 2 and the pins 15 on the first bracket 12.

The obturator 5 is rigidly fixed to the first bracket 12, and more precisely is supported by a flat flange 17 of the crosspiece 14 perpendicular to the two arms 13.

The obturator 5 is provided with a counterweight 18 configured and arranged such as to maintain the obturator 5 in open position when the breathing tube 2 is orientated with the end 3 facing upwards and such as to shift the obturator into the closed position when the breathing tube 2 is orientated with the end 3 facing downwards.

The counterweight 18 advantageously aids the reaching of the open position by the obturator 5 even when a depression occurs internally of the tube 2, which depression is due to the diver's inhaling.

In a preferred solution, the counterweight 18 is made in a single piece with the first bracket 12 and the flange 17 and extends from the crosspiece 14 perpendicularly to the flat flange 17, from the side of the flat flange 17 opposite the side where the obturator 5 is arranged.

The second articulation means comprise a second bracket 20 exhibiting two parallel arms 21 which project from the tube 2, extending perpendicularly from the hinge axis 8, and are reciprocally connected by a crosspiece 22.

The side of the second bracket 20 facing towards the first bracket 12 exhibits a raised sliding plane 29 for the first bracket 12 during oscillation in a same direction of the first bracket 12 and the second bracket 20.

The hinge axis 8 is defined by a pair of rotating pins 23 which extend from the tube 2 radially towards the outside and engage in a respective hole 24 afforded at the end of a respective arm 21 of the second bracket 20. Naturally it is alternatively possible to include the holes 24 on the tube 2 and the pins 23 on the second bracket 20.

The float 6 is hinged to the second bracket 20 with a hinge axis parallel to hinge axis to the tube 2 of the first and second articulation means. The hinge axis of the float 6 to the second bracket 20 is defined by a pin 25 which connects intermediate points of the two arms 21 and extends parallel to the crosspiece 22.

To guarantee an articulated connection that is stable and secure, the float 6 advantageously exhibits an apex wall 26 from which a connecting organ 27 projects, which connecting organ 27 extends longitudinally along the entire length of the pin 25.

The connecting organ 27 exhibits a cylindrical configuration and coaxially surrounds the pin 25, also cylindrical.

The float 6 is entirely arranged at the side of the second bracket 20 opposite the side which faces the first bracket 12. The float 6 further exhibits discharges 28 which extend laterally from the wall 26 from which the connecting organ 27 projects.

The discharges 28 have a double function. Firstly they enable easy manipulation and grip of the float 6 for the engaging of the pin 6, and secondly they serve as support zones which determine the counter-thrust during the assembly by ultrasound welding of the bottom 6*a* of the float 6 to the remaining part 6*b* of the body of the float 6 along the weld line 6*c*.

With the present construction of the breathing device, which includes the obturator 5 rigidly fixed to the bracket 12 in turn freely hinged to the tube 2 with a first oscillating axis, and the float 6 freely hinged to the bracket 20 in turn freely hinged to the tube 2 with a second oscillating axis parallel to but offset in the longitudinal direction of the tube 2 from the first oscillating axis, the transversal volume of the two brackets 12 and 20 can be reduced and the upwards movements of the float 6 and the obturator 5 are optimized, reducing to a necessary minimum the number of components of the automatic closing means of the open end 3 of the tube 2, and providing each component with a sturdiness that is comparable to that of the other components so as to eliminate the presence of a critical element which by breaking can compromise the functioning of the breathing device.

The two brackets 12 and 20 can have the same minimum transversal volume and as the movements thereof are independent, small oscillations of the float 6 do not lead to an undesired closure of the obturator 5.

It should finally be noted too that the reduction in transversal volume of the automatic closing means of the open end 3 of the tube 2, obtained by hinging the two brackets 12 and 20 on two distinct and superposed pairs of pins, also enables a reduction of the volume of the protection cap 40 of the float 6 and the obturator 5 which facilitates the movements of the diver and, not least, enables reducing the packaging of the breathing device.

The breathing device for divers as it is conceived is susceptible to numerous modifications and variants, all falling within the scope of the inventive concept; further, all the details are replaceable by technically-equivalent elements. In practice the materials used, as well as the dimensions thereof, could be any according to requirements and the prior art.

What is claimed is:

1. A breathing device for divers, comprising:

a breathing tube having a longitudinal axis and exhibiting an end having an inclined opening;

an obturator that rotates between an open position and a closed position of the inclined opening of the end, the obturator changing angular orientation relative to the longitudinal axis of the breathing tube during rotation;

a float that activates the obturator;

a first articulator that communicates the obturator with the breathing tube; and a second articulator that communicates the float with the breathing tube, wherein the first and the second articulators each exhibit a respective hinge axis to the breathing tube, extending across the breathing tube, wherein:

the hinge axis to the breathing tube of the second articulator is more greatly distanced from the end of the breathing tube relative to the hinge axis to the breathing tube of the first articulator;

the hinge axis to the breathing tube of the second articulator is parallel to the hinge axis to the breathing tube of the first articulator;

the first articulator comprises a first bracket exhibiting two parallel arms that project from the breathing tube, the two parallel arms extending perpendicularly to the hinge axis to the breathing tube of the first articulator and are reciprocally connected by a crosspiece;

the obturator is rigidly fixed to the first bracket;

the second articulator comprises a second bracket exhibiting two parallel arms that project from the breathing tube, the two parallel arms extending perpendicularly from the hinge axis to the breathing tube of the second articulator and are reciprocally connected by a crosspiece;

the obturator is provided with a counterweight configured to maintain the obturator in an open position when the breathing tube is orientated with the end facing upward and to shift the obturator into a closed position when the breathing tube is orientated with the end facing downward;

the float is rotatable relative to the second bracket, the float changing angular orientation relative to the longitudinal axis of the breathing tube during rotation, the float rotatable on a float hinge axis parallel to the hinge axes to the breathing tube of the first and the second articulators, the float hinge axis to the second bracket being defined by a float pin which connects intermediate points of the two parallel arms of the second bracket and extends parallel to the crosspiece of the second bracket;

the float exhibits an apex wall from which a connecting organ projects, the connecting organ having a cylindrical configuration coaxially wound about the float pin for a whole length thereof, the float further exhibiting discharges that extend laterally from the apex wall from which the connecting organ projects, the float pin extending through the discharges; and a side of the second bracket facing the first bracket exhibits a raised sliding plane for the first bracket during coinciding oscillation thereof.

2. The breathing device of claim 1, wherein the hinge axis to the breathing tube of the first articulator is defined by a pair of rotating pins, one pin at an end of each of the two parallel arms of the first bracket.

3. The breathing device of claim 1, wherein the obturator extends from a flat flange of the crosspiece of the first bracket that is perpendicular to the two parallel arms of the first bracket.

4. The breathing device of claim 1, wherein the hinge axis to the breathing tube of the second articulator is defined by a pair of rotating pins, one pin at an end of each of the two parallel arms of the second bracket.

5. The breathing device of claim 1, wherein a terminal straight longitudinal tract of the breathing tube comprising the inclined end exhibits a reduction in a transversal section thereof defining a recess of the breathing tube for at least partially containing a volume of the float in a transversal direction to the breathing tube, the first and the second articulators exhibiting the respective hinge axes to the breathing tube positioned at the terminal straight longitudinal tract of reduced-section breathing tube.

6. The breathing device of claim 1, wherein coinciding oscillation of the first bracket and the second bracket, occurring by abutment of the raised sliding plane of the second bracket against the first bracket, activates the obturator.

7. The breathing device of claim 1, wherein the float activates the obturator during translation of the float along an axis parallel to the longitudinal axis of the breathing tube and during abutment of the raised sliding plane of the second bracket against the first bracket, wherein the float is free to rotate relative to the second bracket, and change angular orientation relative to the longitudinal axis of the breathing tube during rotation, while the float activates the obturator during translation of the float along an axis parallel to the longitudinal axis of the breathing tube.

8. The breathing device of claim 1, wherein the float activates the obturator during translation of the float along an axis parallel to the longitudinal axis of the breathing tube and during abutment of the raised sliding plane of the second bracket against the first bracket, wherein the float is spaced apart from the crosspiece of the second bracket during translation of the float along an axis parallel to the longitudinal axis of the breathing tube and during abutment of the raised sliding plane of the second bracket against the first bracket.

9. The breathing device of claim 1, wherein rotation of the float relative to the second bracket, and coinciding change in angular orientation of the float relative to the longitudinal axis of the breathing tube during rotation, is maximized and limited by abutment of the apex wall against the crosspiece of the second bracket.

10. A breathing device for divers, comprising:

a breathing tube having a longitudinal axis and an opening at an end thereof;

an obturator in communication with the breathing tube, the obturator being rotatable about a first axis perpendicular to the longitudinal axis of the breathing tube, between an open position and a closed position of the opening; and a float in communication with the breathing tube and activating the obturator to rotate between the open position and the closed position, the float being translatable along an axis parallel to the longitudinal axis of the breathing tube and rotatable about a second axis perpendicular to the longitudinal axis of the breathing tube, the second axis differing from the first axis, wherein the float changes angular orientation relative to the longitudinal axis of the breathing tube during rotation of the float about the second axis;

wherein the float activates the obturator during translation of the float along the axis parallel to the longitudinal axis of the breathing tube;

wherein the float communicates with the breathing tube via a bracket, the bracket rotatable about a third axis perpendicular to the longitudinal axis of the breathing tube, the third axis differing from the first axis and from the second axis, wherein translation of the float along the axis parallel to the longitudinal axis of the breathing tube occurs during rotation of the bracket about the third axis, wherein the bracket changes angular orientation relative to the longitudinal axis of the breathing tube during rotation of the bracket about the third axis.

11. The breathing device of claim 10, wherein the float communicates with the breathing tube independently of the obturator communication with the breathing tube.

12. The breathing device of claim 10, wherein translation of the float along the axis parallel to the longitudinal axis of the breathing tube similarly translates the second axis along the axis parallel to the longitudinal axis of the breathing tube.

13. The breathing device of claim 10, wherein the obturator comprises a planar portion, the planar portion changing angular orientation relative to the longitudinal axis of the breathing tube during rotation of the obturator about the first axis.

* * * * *